US007273443B1

(12) United States Patent
Martinez et al.

(10) Patent No.: US 7,273,443 B1
(45) Date of Patent: Sep. 25, 2007

(54) PORTABLE INTERLOCKING SKATE RAIL ASSEMBLY

(76) Inventors: Juan M Martinez, 1943 S. Naples Ave., Yuma, AZ (US) 85364; Therese Morales, 2161 Dana St., Corona, CA (US) 92879

( * ) Notice: Subject to any disclaimer, the term of this patent is extended or adjusted under 35 U.S.C. 154(b) by 610 days.

(21) Appl. No.: 10/747,745

(22) Filed: Dec. 29, 2003

(51) Int. Cl.
*A63B 21/00* (2006.01)

(52) U.S. Cl. ..... 482/35; 482/36; 482/38

(58) Field of Classification Search ..... 91/35–39, 91/33–34, 14, 15, 16, 17, 23, 142, 130, 41, 91/42
See application file for complete search history.

(56) References Cited

U.S. PATENT DOCUMENTS 3,119,588 A * 1/1964 Keats ..... 248/158
3,294,400 A * 12/1966 Goldstein ..... 273/449
4,378,112 A * 3/1983 Goldstein ..... 482/34
5,037,086 A * 8/1991 Strand ..... 482/34
5,616,102 A * 4/1997 Lahmann ..... 482/34

* cited by examiner

*Primary Examiner*—Jerome Donnelly
(74) *Attorney, Agent, or Firm*—Michael I. Kroll

(57) ABSTRACT

The present invention 10 discloses a portable, modular skate rail comprising a plurality of square or tubular interlocking rail members 12 that may be assembled to provide grind rails of various lengths and elevations. Each rail member 12 has at least one hinged leg support 20 with a hinged footplate 22 that allows the leg support and footplate to be folded in a substantially parallel relation to the rail member to save space during transport and storage. Additionally provided are brackets 38 whereby two rails 12 can be fastened together with one rail having a handle 44 furnishing means for porting the present invention 10 as an integral assembly. The rails 12 of the present invention 10 may also be adapted to provide an angled rail relative to the ground 18.

14 Claims, 10 Drawing Sheets

PORTABLE INTERLOCKING SKATE RAIL ASSEMBLY

BACKGROUND OF THE INVENTION

1. Field of the Invention

The present invention relates generally to skate rails and, more specifically, to a portable, modular skate rail comprising a plurality of square or tubular interlocking rail members that may be assembled to provide grind rails of various lengths and elevations. Each rail member has at least one hinged leg support with a hinged footplate that allow the leg support and footplate to be folded in a substantially parallel relation to the rail member to save space during transport and storage. Additionally provided are brackets whereby two rails can be fastened together with one rail having a handle furnishing means for porting the invention as an integral assembly.

2. Description of the Prior Art

There are other rail devices designed for in-line skating and skateboarding. Typical of these is U.S. Pat. No. Des. 162,337 issued to J. A. O'Gatty on Mar. 6, 1951.

Another patent was issued to Senoh, et al. on Oct. 14, 1980 as U.S. Pat. No. 4,227,688. Another patent was issued to Gangloff on Sep. 2, 1997 as U.S. Pat. No. 5,662,556. Still yet another patent was issued on Feb. 17, 1998 to Levanas as U.S. Pat. No. 5,718,412.

Yet another U.S. Pat. No. 6,551,192 was issued to Rieber, et al. on Apr. 22, 2003 and U.S. Pat. No. 6,554,748 was issued to Tollner on Apr. 29, 2003.

U.S. Pat. No. Des. 162,337

Inventor: James A. O'Gatty

Issued: Mar. 6, 1951

An ornamental design for a sacroiliac bar, as shown and described.

U.S. Pat. No. 4,227,688

Inventor: Hisao Seno, et al.

Issued: Oct. 14, 1980

An exercise assembly with parallel and spaced upright posts, a grip rod spanning the posts and having the opposite end portions movably connected to the posts by means of hollow joints each having a vertical lower pipe section movably receiving the associated end portion of the grip rod and a horizontal pipe section, said opposite end portions of the grip rod having bulges provided with slanted elliptical holes, operation cylinders disposed within said horizontal pipe sections and receiving the opposite end portions of the grip rod, first connector rods received in said operation cylinders and slanted elliptical holes and second connector rods connecting said operation cylinders to said horizontal pipe sections of the joints.

U.S. Pat. No. 5,662,556

Inventor: Robert B. Gangloff

Issued: Sep. 2, 1997

A specially designed foldable exercise apparatus is provided for doing pull-ups-or chin-ups while the heels of the feet remain on the floor. It includes a chrome-plated steel base with welded upright frame bar supports extendable upward on each side of the base, with an uninterrupted space provided between the upright frame bar supports for the torso of user's body to be placed therebetween. The vertical supports extend upward with one on each side, approximately midway between a front edge and a rear edge of the base, so that the base extends outward in both directions from the vertical support posts. The pull-up supports are fabricated with apertures or notched vertical supports or hooks on the exterior for placement therein of a horizontal support bar which is movable. The support bar is preferably fabricated of tubular steel with rubber caps on each end to prevent slipping off the support posts. An optional cross brace is provided to stabilize the support posts in place in a vertical position of use. The user lies between the support posts and pulls himself or herself up to the desired level while the heels of the user remain on the floor.

U.S. Pat. No. 5,718,412

Inventor: Ronald Levanas

Issued: Feb. 17, 1998

A modular series of square or tubular rails are joined to together by rigid or flexible connectors to provide a playing surface in-line skates and skateboards. The rails are separated from the earth or other surface by support columns. The rails themselves can be straight, curved, or can be equipped with a number of bends. Single column supports are preferred for permanent installations where the column can be bolted onto a surface or can be partially buried in the earth. Dual-column supports that form a triangular pattern that enables the rails system to be portable, yet allows skaters to impart horizontal as well as vertical loads on the rails safely. Both columns allow the use of tubular or rectangular rails. Joints between the rail may be flexible to allow a broader range of skating maneuvers.

U.S. Pat. No. 6,551,192

Inventor: Frederick M. Rieber, et al.

Issued: Apr. 22, 2003

Obstacle apparatus includes at least one ramp for launching a bicycle, skateboard or roller blade rider into the air. The apparatus may also include a second similar ramp and a bridge for releasably connecting the elevated ends of the two ramps in-line so as to produce an in-line obstacle over which riders may roll. The apparatus may also include a grind rail which may be releasably attached to the elevated end of one or both of the ramps so that the ramp/rail assembly may be used by skateboarders and the like to perform various acrobatic feats. The apparatus components are rugged and reliable yet they can be made in quantity at minimum cost. Furthermore, because of their unique designs, they may be shipped and stored in a minimum amount of space.

U.S. Pat. No. 6,554,748

Inventor: Bruce Tollner

Issued: Apr. 29, 2003

Multi-functional practice and training apparatus for use by skateboarders, skaters, bicyclists and the like. According to a preferred embodiment, the system comprises the combination of a board with a fulcrum member that are operative to assume at least three practice modes, namely: 1) a ramp mode whereby the fulcrum is placed at one end of the board and creates an upward slope for use in riding or jumping over objects; 2) a seesaw mode whereby the board is pivotally mounted upon the fulcrum and provides a platform surface upon which the user can rock back and forth while standing or riding thereon; and 3) a rigid rail structure whereby the fulcrum defines a rail for use in "grinding."

While these rail assemblies may be suitable for the purposes for which they were designed, they would not be as suitable for the purposes of the present invention, as hereinafter described.

SUMMARY OF THE PRESENT INVENTION

The present invention discloses a portable, modular skate rail comprising a plurality of square or tubular interlocking rail members that may be assembled to provide grind rails of various lengths and elevations. Each rail member has at least one hinged leg support with a hinged footplate that allows the leg support and footplate to be folded in a substantially parallel relation to the rail member to save space during transport and storage. Additionally provided are brackets whereby two rails can be fastened together with one rail having a handle furnishing means for porting the present invention as an integral assembly. The rails of the present invention may also be adapted to provide an angled rail relative to the ground.

A primary object of the present invention is to provide a portable skate rail that may be configured according to the user's requirement.

Another object of the present invention is to provide a portable skate rail comprising a plurality of rail members having a male end and a female end whereby the male end of one rail member is inserted into the female end of the following rail member and so forth.

Yet another object of the present invention is to provide a portable skate rail having folding leg supports with folding foot plates to provide space efficient rail members for transport and storage.

Still yet another object of the present invention is to provide a portable skate rail wherein said rail members and leg supports are designed to allow the user to selectively set up a skate rail configuration with changes in elevation.

Another object of the present invention is to provide a portable skate rail that is simple and easy to use.

Yet another object of the present invention is to provide a portable skate rail that is inexpensive to manufacture and operate.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings.

LIST OF REFERENCE NUMERALS

Figure 1:
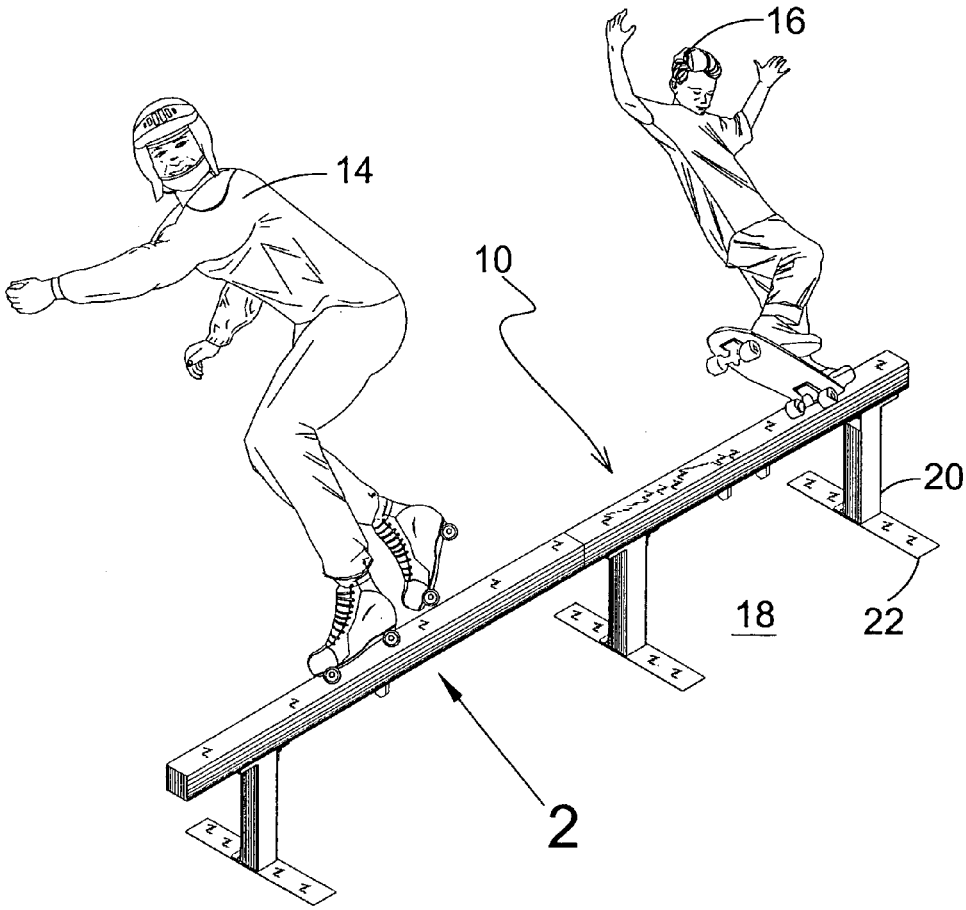
FIG. 1 is an illustrative view of the present invention in use.

With regard to reference numerals used, the following numbering is used throughout the drawings.

10 present invention
12 rail suction
14 skater
16 skate boarder
18 ground
20 support leg
22 footplate
24 playing surface
26 hinge
28 bolt
30 male end
32 female end
34 retainer element
36 tubular rail
38 bracket
40 aperture
42 fastener
44 handle
46 round rail
48 joint
50 low end
52 high end
54 angled rail
56 bore

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrated view of the present invention 10 in use. The present invention 10 is a rail apparatus comprising square or tubular rail sections 12 that are joined together by a rigid distal end that is inserted within an aperture of its counter part rail to provide a playing surface for skaters 14 and skate boarders 16. The rails 12 are positioned off and above the ground 18 by support columns 20. The rails 12 can be straight, curved, round, square or equipped with a plurality of bends in the rails surface. The support columns 20 are hingedly attached to the rails 12 allowing them to be folded in an upward direction for storage. The footplates 22 are hinged to the support columns 20 and also fold to the side of the column and rail 12 and secure to the retainer elements of the rail.

Figure 2:
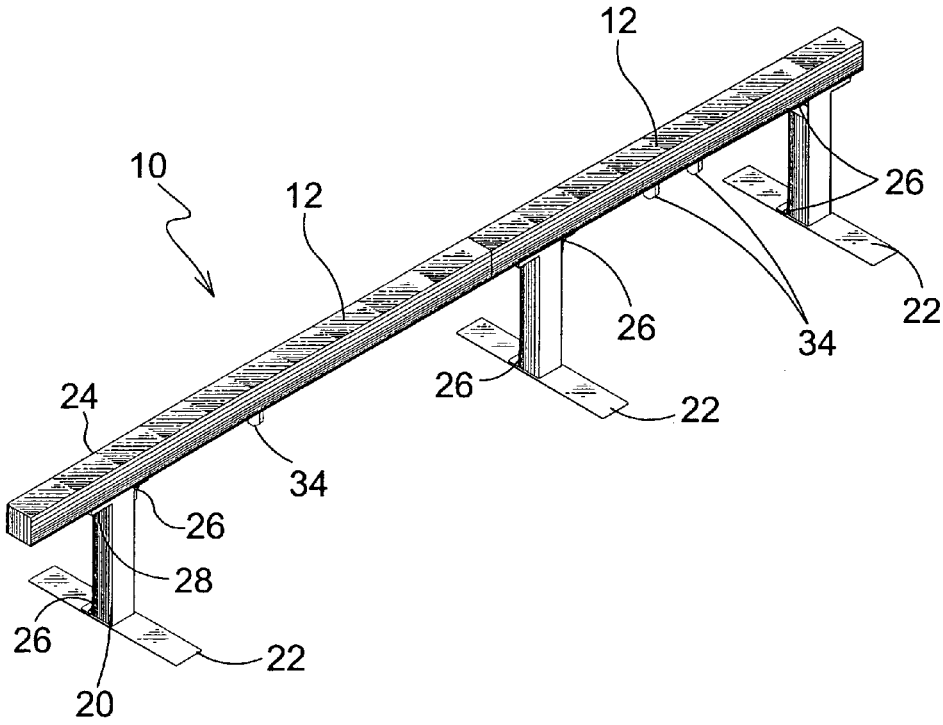
FIG. 2 is a perspective view of the present invention.

Turning to FIG. 2, shown therein is a perspective view of the present invention 10. Shown is the present invention 10 being a rail apparatus is comprised of square or tubular rail sections 12 that are joined together by a rigid distal end that is inserted within an aperture of its counter part rail to provide an upper playing surface 24 for skaters and skate boarders. The rails 12 are positioned off and above the ground by support columns. The support columns 20 are hingedly attached at 26 to the rails 12 allowing them to be folded in an upward direction for storage. The footplates 22 are hinged at 26 to the support columns 20 and also fold to the side of the column and rail 12 and secure to the retainer elements 34 on the bottom of the rail. Also shown is bolt 28.

Figure 3:
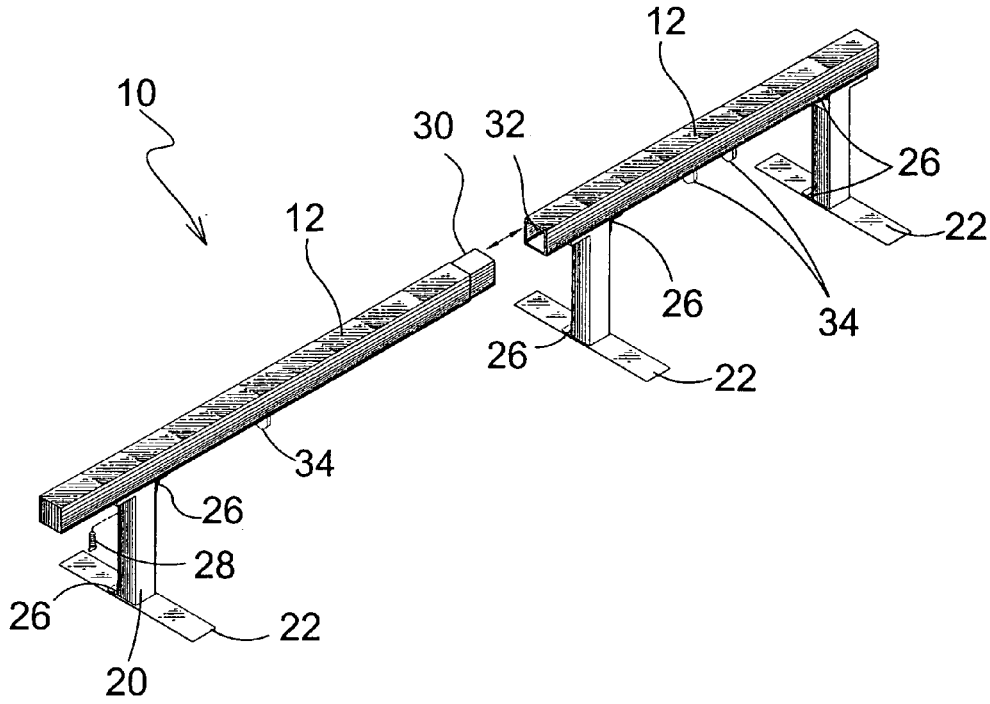
FIG. 3 is an exploded view of the present invention.

Turning to FIG. 3, shown therein is an exploded view of the present invention 10. Shown is the present invention 10 being a rail apparatus having separated connecting rails 12 and is comprised of square or tubular rail sections that are joined together by a rigid distal male end 30 that is inserted within a female aperture 32 on the end of its counter part rail to provide a playing surface for skaters and skate boarders. The rails 12 are positioned off and above the ground by support columns 20. The support columns 20 are hingedly attached at 26 to the rails 12 allowing them to be folded in an upward direction for storage. The footplates 22 are hinged at 26 to the support columns 20 and also fold to the side of the column and rail 12 and secure to the retainer elements 34 of the rail. Bolt 28 is also shown.

Figure 4:
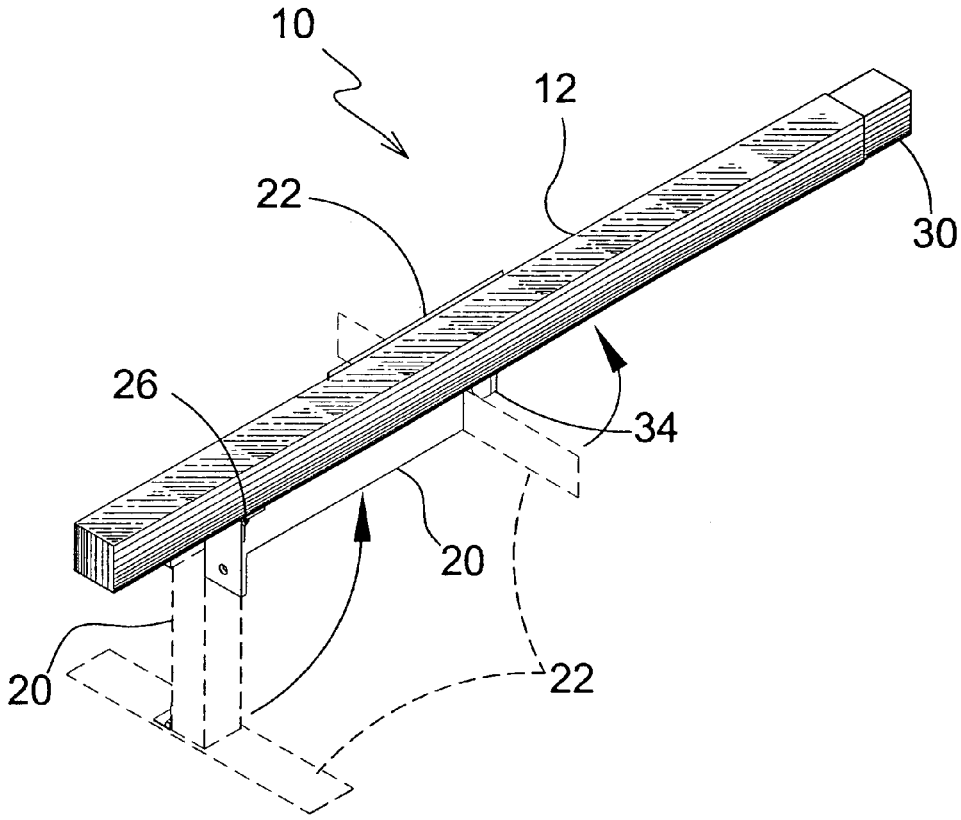
FIG. 4 is a perspective view of the present invention.

Turning to FIG. 4, shown therein is a perspective view of the present invention 10. Shown is a section of the present invention 10 being a rail apparatus having separated connecting rails 12 and is comprised of square or tubular rail sections that are joined together by a rigid distal end 30 that is inserted within an aperture of its counter part rail to provide a playing surface for skaters and skate boarders. The rails 12 are positioned off and above the ground by support columns 20. The support columns 20 are hingedly attached at 26 to the rails 12 allowing them to be folded in an upward direction for storage. The footplates 22 are hinged to the support columns 20 and also fold to the side of the column and rail 12 and secure to the retainer elements 34 of the rail.

Figure 5:
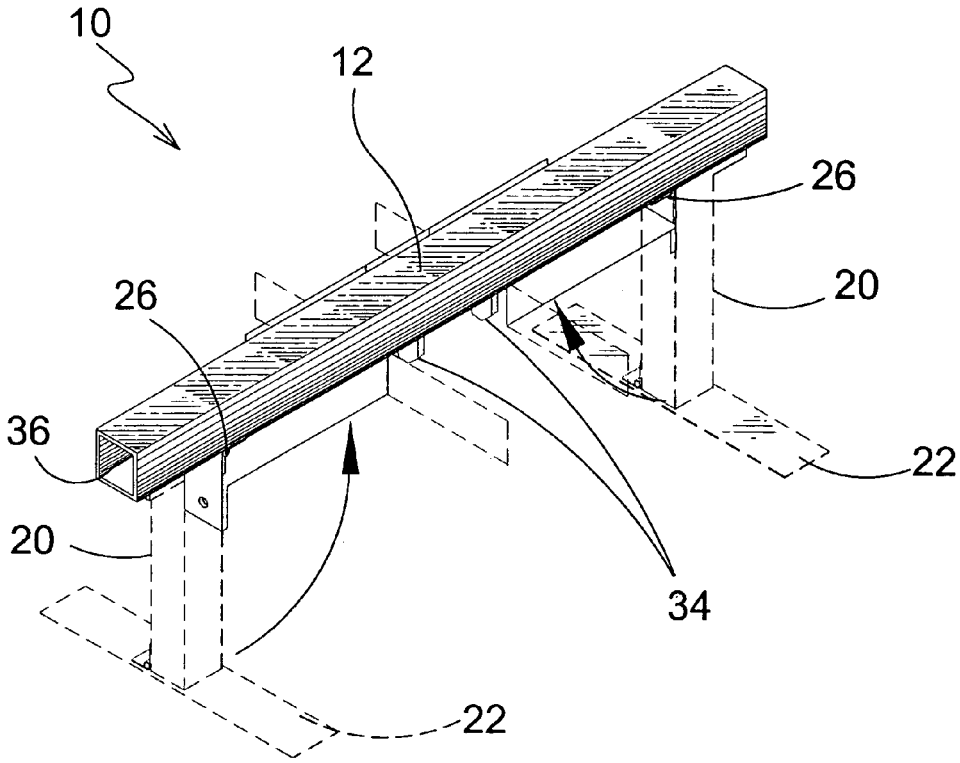
FIG. 5 is a perspective view of the present invention.

Turning to FIG. 5, shown therein is a perspective view of the present invention 10. Shown is a second section of the present invention 10 being a rail apparatus having separated connecting rails 12 and is comprised of square or tubular at 36 rail sections that are joined together by a rigid distal end that is inserted within an aperture of its counter part rail to provide a playing surface for skaters and skate boarders. The rails 12 are positioned off and above the ground by support columns 20. The support columns 20 are hingedly attached at 26 to the rails allowing them to be folded in an upward direction for storage. The footplates 22 are hinged to the support columns and also fold to the side of the column and rail 12 and secure to the retainer elements 34 of the rail.

Figure 6:
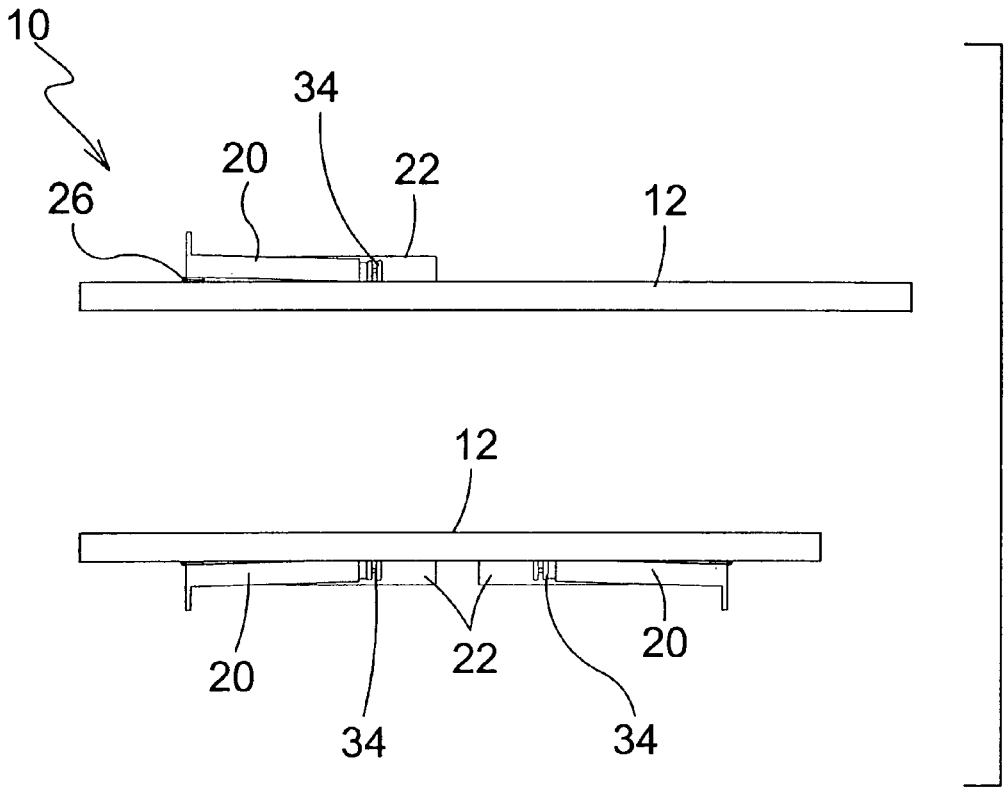
FIG. 6 is an orthographic view of the present invention.

Turning to FIG. 6, shown therein is an orthographic view of the present invention 10. Shown are the two sections 12 of the present invention separated from each other and in a folded position. The rails 12 are joined together by a rigid distal end that is inserted within an aperture of its counter part rail to provide a playing surface for skaters and skate boarders. The rails 12 are positioned off and above the ground by support columns 20. The support columns 20 are hingedly attached at 26 to the rails 12 allowing them to be folded in an upward direction for storage. The footplates 22 are hinged to the support columns 20 and also fold to the side of the column and rail 12 and secure to the retainer elements 34 of the rail.

Figure 7:
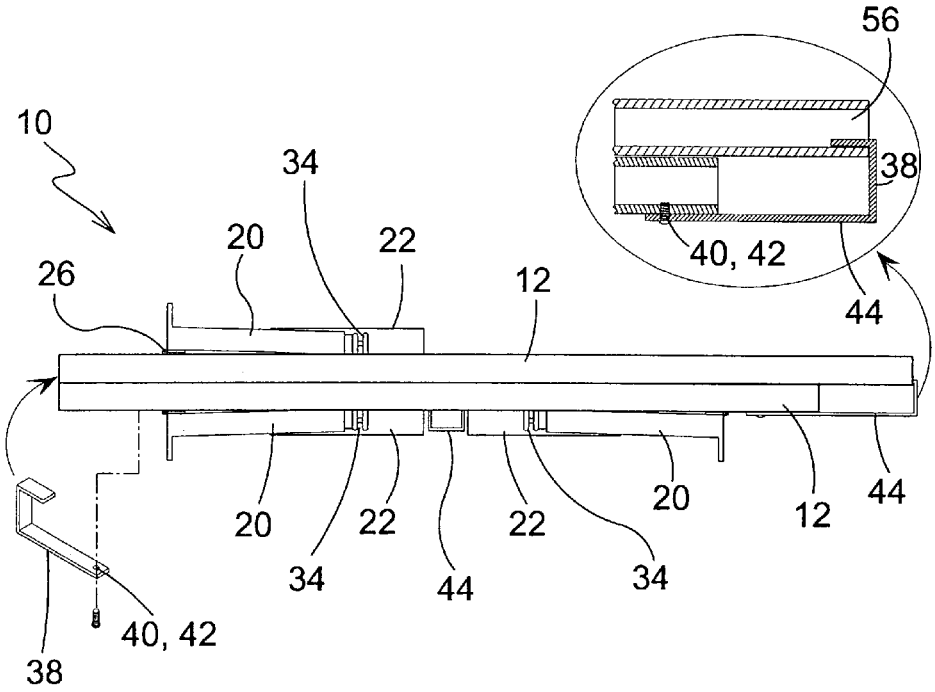
FIG. 7 is an orthographic view of the present invention.

Turning to FIG. 7, shown therein is a side view of the present invention 10 having means for carrying. Shown is the present invention 10 folded having brackets 38 positioned on each distal end. The brackets 38 are substantially U-shaped with one longer leg having a threaded aperture 40 at the distal end whereby a fastener 42 can be inserted therethrough engaging the threaded aperture within the rail 12 with the other bracket leg inserted into the bore 56 of the opposing rail thereby fastening the two rails together. In conjunction with the brackets 38, the handle 44 extending from one rail 12 provides means whereby the present invention 10 can be handled as an integral assembly. Other previously disclosed elements are also shown.

Figure 8:
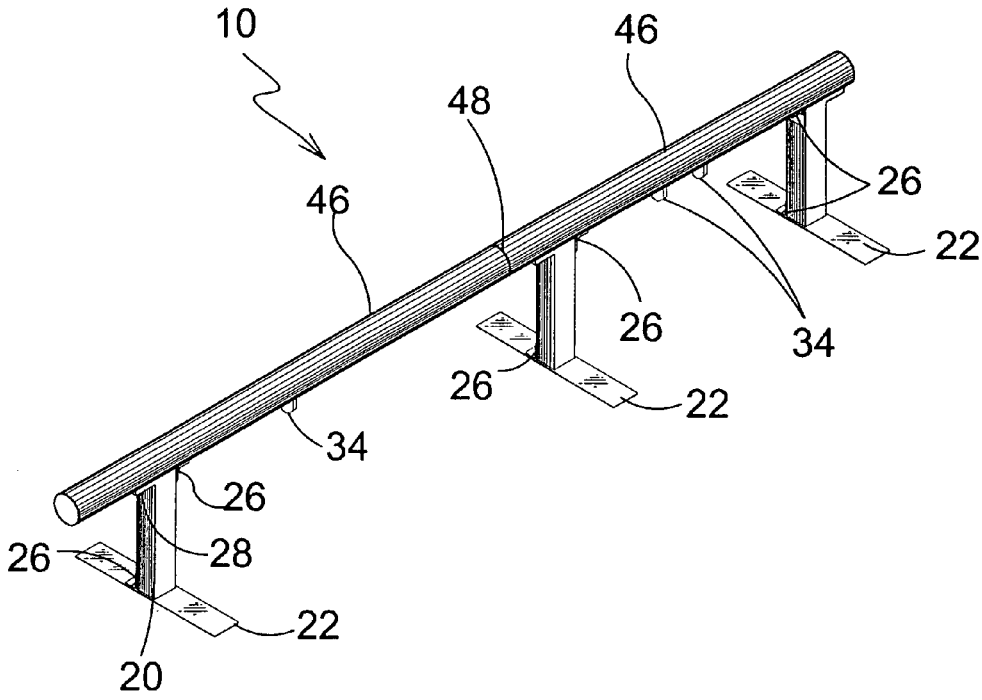
FIG. 8 is an alternate view of the present invention.

Turning to FIG. 8, shown therein is an alternate view of the present invention 10. Shown is a round rail 46 version of the present invention 10 being a rail apparatus comprised of round rail sections that are joined together by a rigid distal end that is inserted within an aperture of its counter part rail at 48 to provide a playing surface for skaters and skate boarders. The rails 46 are positioned off and above the ground by support columns 20. The rails 46 can be straight, curved, round, square or equipped with a plurality of bends in the rails surface. The support columns 20 are hingedly attached at 26 to the rails 46 allowing them to be folded in an upward direction for storage. The footplates 22 are hinged to the support columns and also fold to the side of the column and rail 46 and secure to the retainer elements 34 of the rail.

Figure 9:
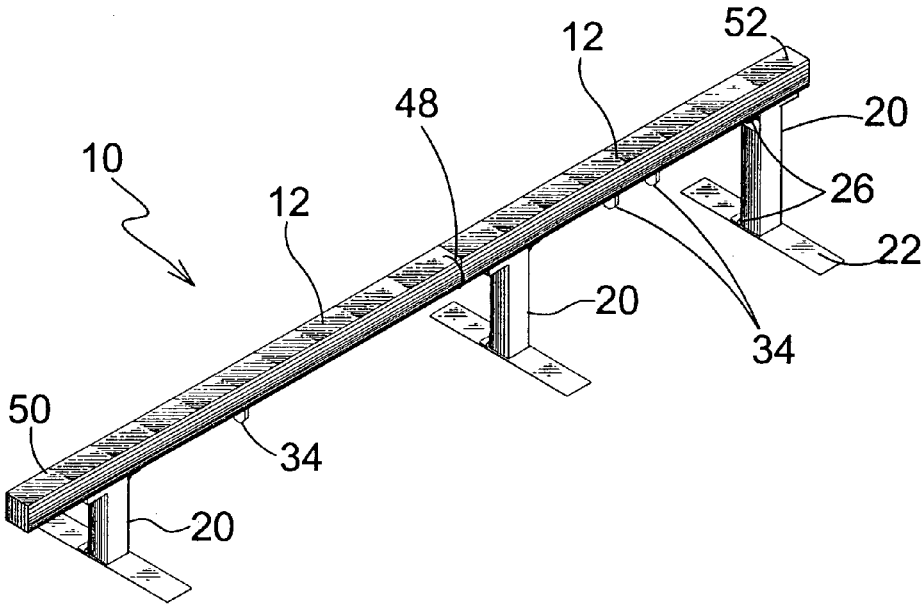
FIG. 9 is a perspective view of the slant rail of the present invention.

Turning to FIG. 9, shown therein is a perspective view of the slant rail of the present invention 10. Shown is the slant rail version of the present invention 10 being a rail apparatus is comprised of square rail sections 12 that are joined together by a rigid distal end that is inserted within an aperture of its counter part rail at 48 to provide a playing surface for skaters and skate boarders. The rails 12 are positioned off and above the ground by support columns 20 of different lengths to place the rails 12 on an angle so as to have a low 50 and high 52 end. The rails 12 can be straight, curved, round, square or equipped with a plurality of bends in the rails surface. The support columns 20 are hingedly attached at 26 to the rails allowing them to be folded in an upward direction for storage. The footplates 22 are hinged at 26 to the support columns and also fold to the side of the column and rail and secure to the retainer elements 34 of the rail.

Figure 10:
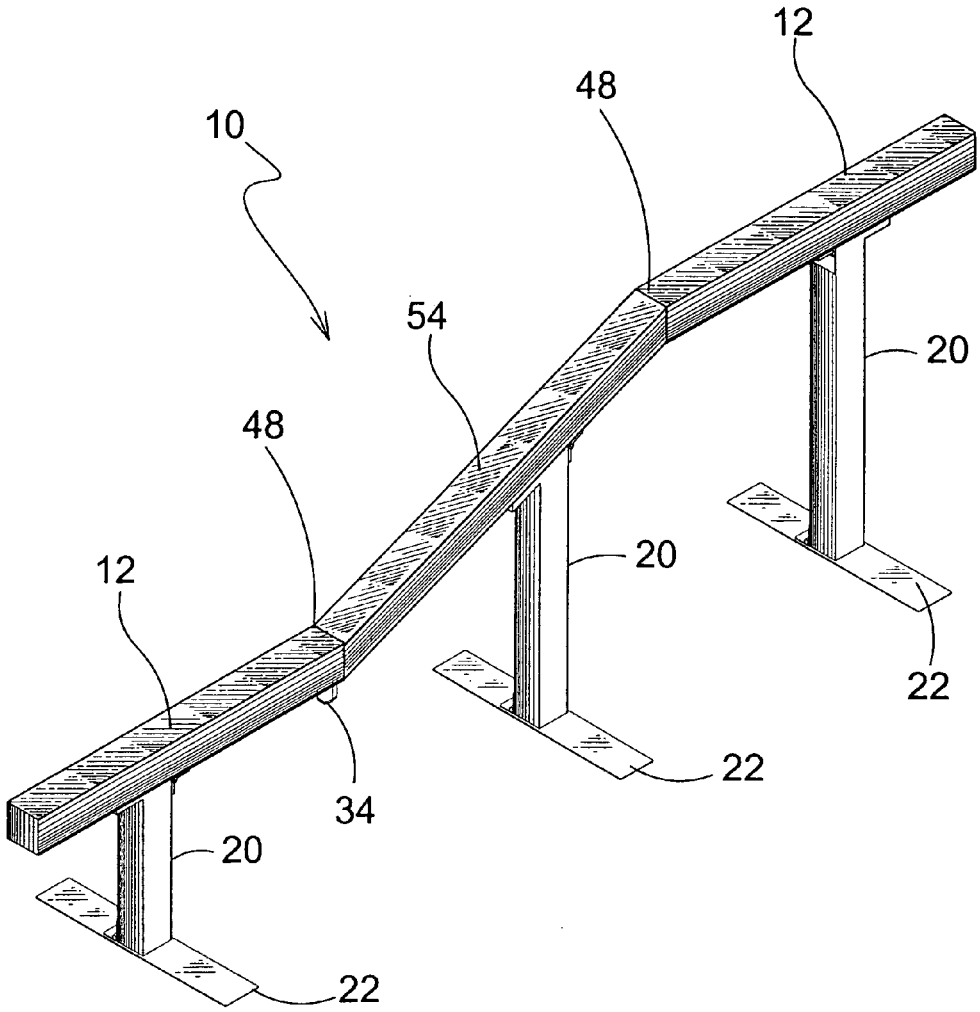
FIG. 10 is a perspective view of the kinked rail of the present invention.

Turning to FIG. 10, shown therein is a perspective view of the kinked rail of the present invention 10. Shown is the kinked or angled rail 54 version of the present invention 10 being a rail apparatus is comprised of square or tubular rail sections 12 that are joined together by a rigid distal end that is inserted within an aperture at 48 of its counter part rail to provide a playing surface for skaters and skate boarders. The rails 12 are positioned off and above the ground by support columns. The rails 12 can be straight, curved, round, square or equipped with a plurality of bends in the rails surface. The support columns 20 are hingedly attached to the rails allowing them to be folded in an upward direction for storage. The footplates 22 are hinged to the support columns and also fold to the side of the column and rail and secure to the retainer elements 34 of the rail.

I claim:

1. An apparatus for providing a portable interlocking skate assembly, in combination, comprising:

a) a first and second rail section, each said rail section being elongated having first and second opposing ends and a top and bottom;

b) wherein said first end comprises a male end thereon and said second end comprises a female aperture therein, said second end for receiving said first end therein so as to join said rail sections together, a playing surface being thereby formed on said top of said joined rail sections to provide a skating surface;

c) at least one support leg being disposed adjacent said first or second end of each said rail section, said support leg being disposed on said bottom of each said rail section, said support leg having first and second opposing ends, wherein said first end of each said support leg is hinged to said rail section to permit the support leg to be folded upwardly toward the bottom of the rail section between the first and second ends of the rail section; and, d) a footplate being disposed on said second end of each said support leg to permit the support legs and rail sections to stand upright above a support surface, wherein each said footplate is hinged to said support leg to permit the footplate to be folded to a position parallel to and adjacent to the support leg;

e) a retainer member being disposed on said bottom of said rail in a position so as to secure said support leg in the folded position, wherein said support leg is secured to said bottom of said rail section;

f) a bracket adapted to connect said first and second rail sections together and thereafter to allow said first and second rail sections to be separated from each other; and wherein said bracket is U-shaped and comprises:

g) a first bracket leg that is longer than a second bracket leg, said longer bracket leg having an aperture therein;

h) wherein said longer bracket leg is attached to said first end of said first rail section having a fastener pass through said aperture into said first rail section to permit the first rail section to be joined to the longer bracket leg; and, i) wherein said second bracket leg is attached to said first end of said second rail section so as to removably join said first and second rail sections together.

2. The apparatus of claim 1, further comprising a carrying handle being disposed intermediate said opposing ends of said first and second rail sections to permit the rail sections to be carried about when they are joined together.

3. The apparatus of claim 2, wherein said first and second rail sections are tubular having a bore therein.

4. The apparatus of claim 3, wherein said second bracket leg is disposed inside said bore of said first end of said second tubular rail section so as to removably join said first and second tubular rail sections together.

5. The apparatus of claim 4, wherein said first and second rail sections are square.

6. The apparatus of claim 5, wherein said first and second rail sections are round.

7. The apparatus of claim 6, wherein said first and second rail sections form a straight playing surface when they are joined together.

8. The apparatus of claim 7, wherein said first and second rail sections form a curved playing surface when they are joined together.

9. The apparatus of claim 8, wherein said first and second rail sections form a round playing surface when they are joined together.

10. The apparatus of claim 9, wherein said first and second rail sections form a square playing surface when they are joined together.

11. The apparatus of claim 10, wherein said first and second rail sections form a playing surface having multiple bends therein when said rail sections are joined together.

12. The apparatus of claim 11, wherein said first and second rail sections form a playing surface wherein a first end is higher than a second end when said rail sections are joined together.

13. The apparatus of claim 12, wherein said first end of said first rail section is higher than said second end.

14. The apparatus of claim 13, wherein said first end of said second rail section is higher than said second end.

* * * * *